US008876218B2

(12) United States Patent
Weigel et al.

(10) Patent No.: US 8,876,218 B2
(45) Date of Patent: Nov. 4, 2014

(54) HYDRAULIC CIRCUIT FOR LONGWALL SUPPORT

(75) Inventors: Wilfried Weigel, Werne (DE); Gerhard Wülfing, Velbert (DE); Peter Rahms, Billerbeck (DE)

(73) Assignee: Tiefenbach Control Systems GmbH, Bochum (DE)

( * ) Notice: Subject to any disclaimer, the term of this patent is extended or adjusted under 35 U.S.C. 154(b) by 132 days.

(21) Appl. No.: 13/420,891

(22) Filed: Mar. 15, 2012

(65) Prior Publication Data

US 2012/0170981 A1 Jul. 5, 2012

Related U.S. Application Data

(63) Continuation-in-part of application No. 13/382,207, filed as application No. PCT/DE2010/000685 on Jun. 18, 2010.

(30) Foreign Application Priority Data

Jul. 16, 2009 (DE) ..... 10 2009 033 572
Feb. 18, 2012 (DE) ..... 10 2012 003 087

(51) Int. Cl.
*E21D 23/26* (2006.01)
*E21C 35/16* (2006.01)

(52) U.S. Cl.
CPC ..... *E21D 23/26* (2013.01); *E21C 35/16* (2013.01)
USPC ..... 299/1.7; 405/302

(58) Field of Classification Search
CPC ..... E21D 23/26; E21D 23/16; E21C 35/16; E21C 35/14
USPC ..... 299/1.3, 1.7; 405/302; 91/170 MP
See application file for complete search history.

(56) References Cited

U.S. PATENT DOCUMENTS 3,672,174 A 6/1972 Hippel
3,724,329 A * 4/1973 Grebe ..... 91/189 R
4,109,472 A * 8/1978 Harris ..... 405/302
4,146,271 A * 3/1979 Ward et al. ..... 299/1.7
4,485,724 A 12/1984 Demircan et al.

(Continued)

FOREIGN PATENT DOCUMENTS

CN 1916429 A 2/2007
DE 12 55 613 B 12/1967

(Continued)

OTHER PUBLICATIONS

Office Action for Chinese Application No. 201080005407.3 dated Mar. 5, 2014.

(Continued)

*Primary Examiner* — David Bagnell
*Assistant Examiner* — Michael Goodwin
(74) *Attorney, Agent, or Firm* — Alston & Bird LLP

(57) ABSTRACT

A hydraulic circuit for longwall support for use in underground mining for supporting a longwall by means of a plurality of support shields includes in the annular piston line of each cylinder/piston unit a pressure sensor. The pressure sensor, upon reaching a predetermined maximum pressure activates a pressure deviation signal, causes the entire longwall to be depressurized by means of a longwall shut-off valve. The pressure deviation signal is blocked for one of the hydraulic valves against each triggering signal.

2 Claims, 1 Drawing Sheet

(56) References Cited

U.S. PATENT DOCUMENTS

| | | | | |
|---|---|---|---|---|
| 4,904,115 | A * | 2/1990 | Lebreton | 405/143 |
| 5,060,556 | A * | 10/1991 | Weirich et al. | 91/527 |
| 6,957,166 | B1 * | 10/2005 | Howie et al. | 702/173 |
| 7,428,861 | B2 * | 9/2008 | Dettmers et al. | 91/508 |
| 7,478,884 | B2 * | 1/2009 | Kussel | 299/1.7 |
| 7,810,424 | B2 * | 10/2010 | Voss | 91/170 MP |
| 2004/0258487 | A1 * | 12/2004 | Suilmann et al. | 405/294 |
| 2006/0042243 | A1 | 3/2006 | Kussel | |
| 2012/0104829 | A1 | 5/2012 | Weigel et al. | |

FOREIGN PATENT DOCUMENTS

| | | | |
|---|---|---|---|
| DE | 14 58 672 | B1 | 2/1970 |
| DE | 14 83 906 | A1 | 7/1970 |
| DE | 28 38 374 | B1 | 1/1980 |
| DE | 31 28 279 | A1 | 2/1983 |
| DE | 3804848 | A1 | 8/1989 |
| DE | 198 42 460 | A1 | 3/1999 |
| DE | 102 07 698 | A1 | 10/2002 |
| DE | 10 2004 017 712 | A1 | 12/2004 |
| DE | 10 2006 05539 | A1 | 11/2007 |
| EP | 1 752 664 | A2 | 2/2007 |
| GB | 2329429 | A * | 3/1999 |
| WO | WO-2005/054629 | A1 | 6/2005 |
| WO | WO 2011/006461 | A2 | 1/2011 |

OTHER PUBLICATIONS

International Search Report and Written Opinion for Application No. PCT/DE2010/000685 dated Feb. 17, 2012.

International Search Report for Application No. PCT/DE2013/000053 dated Apr. 1, 2014.

International Preliminary Report on Patentability and Written Opinion for International Application No. PCT/DE2013/000053 dated Aug. 19, 2014.

* cited by examiner

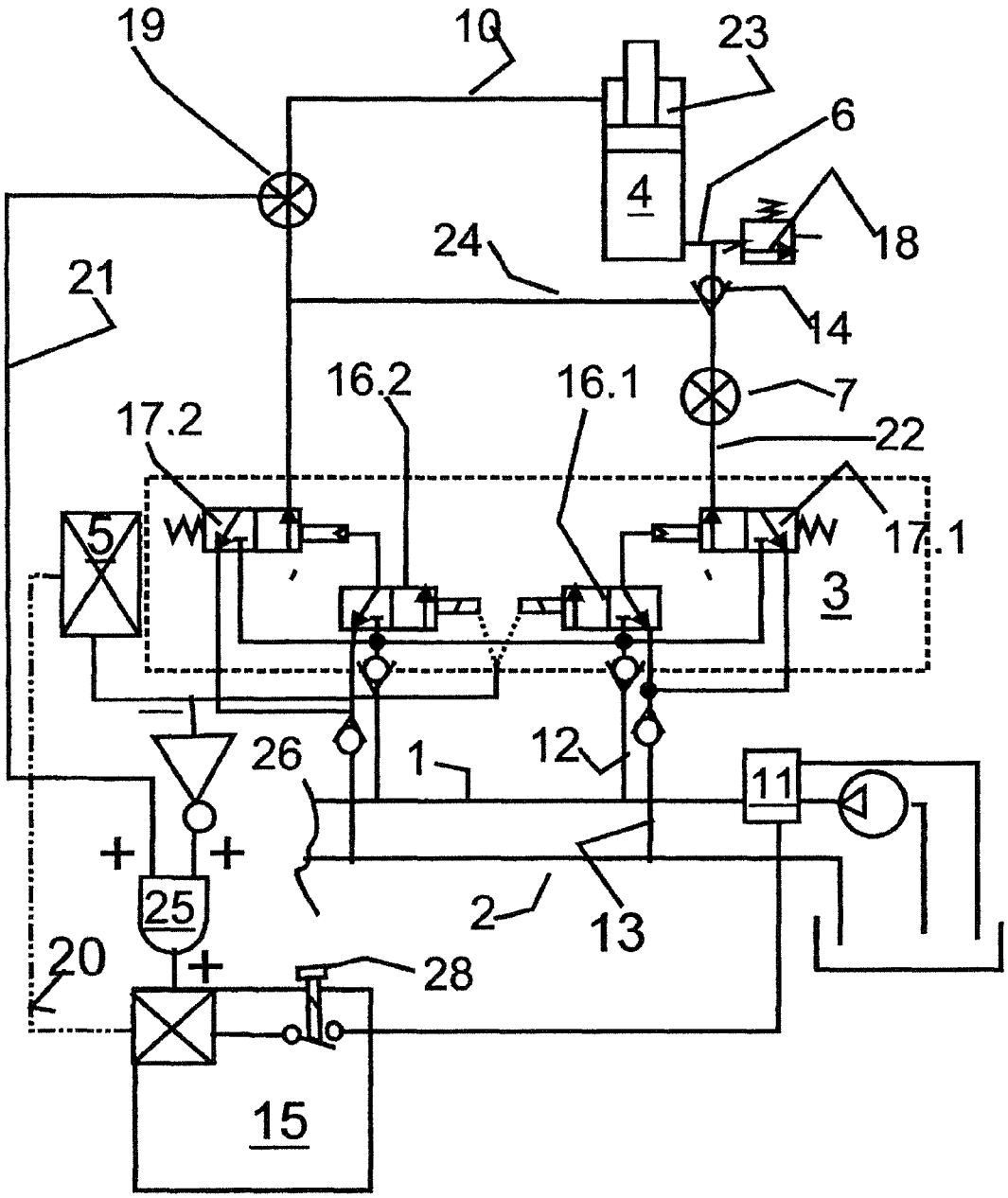
19
10
23
6
4
18
24
21
14
16.2
16.1
7
17.2
22
5
17.1
3
26
1
12
11
+
+
25
2
13
20
28
+
15

HYDRAULIC CIRCUIT FOR LONGWALL SUPPORT

CROSS-REFERENCE TO RELATED APPLICATIONS

The present application is a continuation-in-part of U.S. patent application Ser. No. 13/382,207, filed on Jan. 4, 2012, which is a national phase application of International Application No. PCT/DE2010/000685, filed on Jun. 18, 2010, which claims priority to German Patent Application No. 10 2009 033 572.2, filed on Jul. 16, 2009, and the present application also claims priority to German Patent Application No. 10 2012 003 087.8, filed on Feb. 18, 2012, each of which is hereby incorporated herein in its entirety by reference.

BACKGROUND OF THE INVENTION

1. Field of the Invention

The invention relates to a hydraulic circuit for longwall support by means of a support device (support shield) for use in underground mining.

2. Description of Related Art

Such circuits are well known from PCT/DE2010/000685 (the publication of which is W02011006461A2). The proposed pressure monitoring system prevents unforeseen operating conditions where pressure conditions may occur that are sufficient to manipulate the hydraulic pilot control, i.e. the opening of essential valves even in case of failures to the pumping system, or if in case of an emergency the overall electric and hydraulic control systems are switched off, or in case of extremely high pressures from the rock which the load maintaining valves are not capable of handling.

The arrangement of W02011006461A2 according to one embodiment also monitors the annular piston line for each cylinder/piston assembly by means of a pressure sensor. When a pre-determined maximum pressure is achieved, the entire longwall is depressurized so that particularly the unlocking process for the check valves that retain the rock pressure is disabled. This can, however, cause operating conditions that may require the system to be controlled either manually or automatically.

The purpose of the invention is to design the circuit in such a manner that a comprehensive monitoring of the system as well as any necessary manipulation of the control system is possible.

SUMMARY OF VARIOUS EMBODIMENTS

This is achieved by means of the various embodiments described herein.

An alternate embodiment includes a supplementary improvement that allows for a so-called negative emergency operation, and therefore enables the control if, due to a pressure signal activated by the pressure monitor, an emergency signal would cause a system failure.

BRIEF DESCRIPTION OF THE SEVERAL VIEWS OF THE DRAWINGS

The invention is hereafter described by means of a preferred embodiment. Explicit reference is made to the drawing descriptions relating to FIGS. 1A, 1B and 2 of W02011006461A2 and particularly to FIG. 1B and its description.

The terms used and their reference signs are also taken up in this application. Any divergences will be expressly noted in the following detailed description of the invention.

FIG. 1 is an electrical/hydraulic circuit of a support shield in a longwall mine in accordance with an embodiment of the present invention.

DETAILED DESCRIPTION

The electric/hydraulic circuit of a support unit in a longwall according to W02011006461A2 comprises the following elements, which are also illustrated or indicated in the drawing:

1. the longwall supply line 1 (pumps—manifold, flow pipe), which extends through a portion of the longwall or the entire length of the longwall and which is connected to the pump station—without reference mark.
2. the return flow manifold 2 (return flow—manifold, return flow), which extends through a portion of the longwall or the entire length of the longwall and which is connected to the tank—without reference mark—of the pump station.
3. the hydraulic control device of the shield control device for a support shield. Shown is one of the power transmitters 4. The hydraulic control device 3 is connected through the feed line stub 12 with the feed line and through the return line stub 13 with the return line.
4. A power transmitter, which is here illustrated as cylinder-piston unit.
5. The electrical control device 5 of the shield control unit for controlling the hydraulic control device 3. The hydraulic control device 3 and the electrical control device 5 together comprise the excavation control device, which is designed for inputting switching and control commands, however, may also receive its switching and control commands from the central longwall control device 15.

Other existing secondary valves, particularly check valves, have not been illustrated or further described.

The hydraulic control device comprises multiple valves. The connection for each power transmitter 4 with the pump manifold of the longwall between the power transmitter outlet, which is acted upon by the rock pressure, and the hydraulic control device 5 is generally blocked by a pressure holding valve 14 which is designed as an unlockable check valve so that in case the pump pressure fails or is turned off the load pressure of the power transmitter acts upon the tightly locking check valve 14. This check valve 14 can be unblocked by means of hydraulic pilot operation through the system pressure when the pressure variation between load pressure and pilot pressure fall below a value that is predetermined by the valve construction. The check valve 14 is hydraulically designed in such a manner that when it is hydraulically unblocked the working space of the power transmitter is through outlet 6 and the return line stub connected with the return line manifold. Such unlockable check valve is, for example, well known through DE 38 04 848 A1.

The pressure monitoring device 19 prevent the pressure between the unlockable check valve 14 and the cylinder annular space and/or the hydraulic control device 3 from reaching a level that could cause the check valve 14, which acts as a load maintaining valve, from being unintentionally unlocked (turned on). See also W02011006461A2.

The detailed drawing of FIG. 1 illustrates the individual valves of the hydraulic control device 3.

The pilot control valve 16.1 for setting the power transmitter and the pilot control valve 16.2 for removing the power transmitter are both activated through bus line 20 by means of the electric control device 5 of the support shield and/or by means of the central longwall control unit 15 through the signal line 21 and hydraulically activate the main valve 17.1 for setting the power transmitter and main valve 17.2 for removing the power transmitter between two settings.

The encoding of the switching signals causes the magnet of the pilot control valves to be interlocked in the following manner:

- when hydraulically actuated in the course of setting (lifting):
  - Main valve 17.1 opens the connection (feed line stub 12, setting line 22) between longwall supply line (pump line, pressure line) 1 and power transmitter input 6;
  - Main valve 17.2 releases the connection (annular piston line 10, return line stub 13) of the annular space 24 to the return line manifold 2.
  - The piston of power transmitter 4 and the load acting upon it are elevated.
- at standstill:
  - Main valve 17.1 blocks the connection between connection 6 of the power transmitter and longwall supply line (pump line, pressure line) 1 and opens the connection to the return line manifold 2.
  - Main valve 17.2 releases the connection of the annular space 23 to the return line manifold 2.
  - The load acting upon the piston of the power transmitter is held by the blocked check valve 14/load maintaining valve.
- when hydraulically actuated in the course of removing the timbering (lowering the piston):
  - Main valve 17.1 blocks the connection between longwall supply line (pump line, pressure line) 1 and opens the connection to the return line manifold 2.
  - Main valve 17.2 releases the connection of the annular space 23 to the longwall supply line (pump line, pressure line) 1.
  - The load acting upon the piston of the power transmitter is held by the blocked check valve 14/load maintaining valve until the check valve 14 is unblocked by the rising pressure in the annular piston line 10 through line stub 24.
  - The load acting upon the piston of the power transmitter is thus lowered.

Standstill is a critical condition since persons staying inside the longwall are subject to injury or death from the unintentional movement of the expansion equipment. This hazard is prevented by the pressure sensor 19 which is installed into annular piston line 10 of each cylinder/piston assembly 4. Each of these pressure sensors 19 is switched through another bus line 20 to the longwall shutoff valve 11 through the central longwall control device 15 in such a manner that upon reaching a predetermined maximum pressure in the annular piston line 10 the entire longwall is pressureless switchable. This also ensures that internal pressure, which could cause the unblocking of the check valves that are holding the rock pressure, is no longer present. Therefore the maximum allowable pressure at which all support units of the longwall are depressurized is set significantly lower, in fact at least 20% lower, for example, at 50 bar, than the inherent pressure of, for example, 80 bar that is sufficient to unlock the check valve.

It is, however, possible for operating conditions to occur for which it may become desirable or even necessary to manually adjust the control system. For this reason it is intended that the longwall shutoff valve 11 can only be activated when a triggering signal for the main valves 16.1, 16.2 is no longer present. For this reason the central longwall control device 15 is activated through a UND—member 25, which only sends a positive output signal if the pressure signal of the pressure sensor 19 is positive and at the same time the signal for triggering the pilot control valves 16.1, 16.2 is negative. This is here illustrated by means of a negative (NANO) member 26, which is connected with the signal line 21 and only sends a positive output signal to the UND member 25 of the longwall control device 15 when a negative input signal is present. This prevents the possibility that the pressure sensor 19 interferes with any intentional manually or automatically controlled operating condition or process of the power transmitter. Such a situation could cause serious hazards.

It is furthermore intended that the function of the pressure sensor 19 can be completely disabled. For this purpose a push button switch 28 is installed in the line between longwall control device 15 and longwall shutoff valve 11. If necessary, this push button switch can be opened when it is disadvantageous that the entire longwall is shut off accidentally. It is also possible to bypass the pressure sensor by means of a circuit which is not illustrated here.

That which is claimed:

1. A hydraulic circuit for longwall support for use in underground mining for supporting a longwall by means of a plurality of support shields where each support shield comprises:

at least one hydraulic cylinder/piston unit configured to perform support functions such as removing timbering, progressing, and setting, wherein the at least one cylinder/piston unit is connected with a shield control valve by an unblockable check valve and a pressure line, wherein, upon demand by a shield control device that is assigned to each support shield, the at least one cylinder/piston unit is either connected by the shield control valve with a pump line, or, when the check valve is simultaneously unblocked, is connected with a return line, or is blocked against the pressure line by the check valve, wherein an annular piston line of the at least one cylinder/piston unit is monitored by means of a pressure sensor, which in turn activates a pressure deviation signal when a predetermined maximum pressure is reached, which causes the hydraulic circuit to be depressurized by means of a longwall shut-off valve such that the check valve remains blocked, and wherein the pressure deviation signal is locked against a triggering signal of the shield control device such that the pressure deviation signal does not cause the longwall shut-off valve to become depressurized if the triggering signal is present.

2. The hydraulic circuit according to claim 1, wherein the pressure deviation signal can be deactivated manually or the pressure sensor can be bypassed.

* * * * *